US011228126B2

(12) United States Patent
Tan et al.

(10) Patent No.: US 11,228,126 B2
(45) Date of Patent: Jan. 18, 2022

(54) DUAL IN-LINE MEMORY MODULES (DIMM) CONNECTOR TOWERS WITH REMOVABLE AND/OR LAY-FLAT LATCHES

(71) Applicant: Intel Corporation, Santa Clara, CA (US)

(72) Inventors: Guixiang Tan, Portland, OR (US); Xiang Li, Portland, OR (US); Casey Winkel, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 45 days.

(21) Appl. No.: 16/739,006

(22) Filed: Jan. 9, 2020

(65) Prior Publication Data

US 2020/0144748 A1 May 7, 2020

(51) Int. Cl.
*H01R 12/73* (2011.01)
*H01R 43/26* (2006.01)
*H01R 12/70* (2011.01)

(52) U.S. Cl.
CPC ..... *H01R 12/737* (2013.01); *H01R 12/7029* (2013.01); *H01R 43/26* (2013.01)

(58) Field of Classification Search
CPC .. H01R 12/737; H01R 43/26; H01R 12/7029; H01R 12/72; H01R 17/73; H01R 12/83; H01R 12/721; H01R 12/7005; H01R 13/6275
USPC ..... 439/62, 325–328, 630, 637, 487
See application file for complete search history.

(56) References Cited

U.S. PATENT DOCUMENTS 4,241,966 A * 12/1980 Gomez ..... H01R 12/7005 439/157
6,007,357 A * 12/1999 Perino ..... H01R 12/7005 439/327
6,315,263 B1 * 11/2001 Wang ..... H05K 7/1431 248/346.3
6,353,541 B1 * 3/2002 Leman ..... G06F 1/183 211/41.17
6,487,086 B2 * 11/2002 Ikeda ..... G11C 5/04 257/723
6,775,139 B2 * 8/2004 Hsueh ..... G06F 1/184 165/104.33
7,023,701 B2 * 4/2006 Stocken ..... G06F 1/20 165/185

(Continued)

*Primary Examiner* — Travis S Chambers
(74) *Attorney, Agent, or Firm* — Schwabe, Williamson & Wyatt, P.C.

(57) ABSTRACT

Embodiments are directed towards apparatuses, methods, and systems for a connector having a housing body to couple a dual in-line memory module (DIMM) to a printed circuit board (PCB). In embodiments, the housing body includes first and second opposing ends of the connector and a first and a second latch coupled at the respective first and second opposing ends of the connector to engage the DIMM. In embodiments, the first and the second opposing ends have respective first and second heights relative to a height of the housing body to allow the DIMM to be inserted or removed at an angle when disengaged from the first and second latch. In embodiments, one or more of the latches are removably coupled to the connector and/or can be rotated into a lay-flat position to allow the DIMM to be removed at an angle. Additional embodiments may be described and claimed.

18 Claims, 6 Drawing Sheets

(56) References Cited

U.S. PATENT DOCUMENTS

| | | | | |
|---|---|---|---|---|
| 7,371,103 | B2 * | 5/2008 | McGrath | H01R 12/7005 439/327 |
| 7,474,529 | B2 * | 1/2009 | Tian | G11C 5/04 165/185 |
| 7,480,147 | B2 * | 1/2009 | Hoss | G06F 1/20 361/715 |
| 7,553,163 | B2 * | 6/2009 | McAlonis | H05K 1/142 439/326 |
| 7,661,974 | B1 * | 2/2010 | Sun | H05K 7/1431 439/328 |
| 7,791,881 | B2 * | 9/2010 | Chou | H01L 23/40 361/695 |
| 7,929,307 | B2 * | 4/2011 | Hsieh | H01L 23/467 361/707 |
| 8,730,670 | B1 * | 5/2014 | Zohni | H01L 23/367 361/690 |
| 8,848,379 | B2 * | 9/2014 | He | H01R 12/721 361/737 |
| 9,155,194 | B1 * | 10/2015 | Sullivan | H05K 1/14 |
| 9,848,512 | B2 * | 12/2017 | Wright | H05K 1/0259 |
| 10,720,722 | B2 * | 7/2020 | Tsorng | H01R 12/716 |
| 2006/0221573 | A1 * | 10/2006 | Li | H01L 23/36 361/704 |
| 2009/0219687 | A1 * | 9/2009 | Lin | H05K 7/1431 361/695 |
| 2010/0188817 | A1 * | 7/2010 | Chou | H01L 23/467 361/697 |
| 2013/0291368 | A1 * | 11/2013 | Davidson | G06F 1/20 29/592.1 |
| 2015/0382508 | A1 * | 12/2015 | Tatta | H05K 7/20545 361/716 |
| 2016/0254061 | A1 * | 9/2016 | Kanapathippillai | G11C 5/14 361/737 |

* cited by examiner

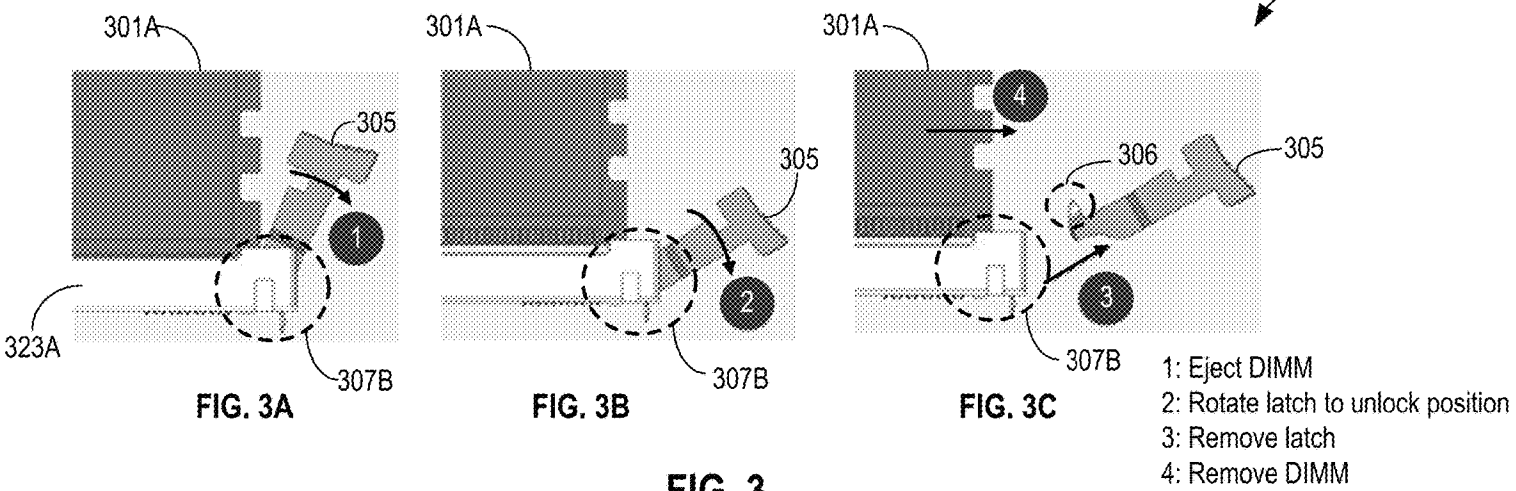
FIG. 3A
FIG. 3B
FIG. 3C
FIG. 3
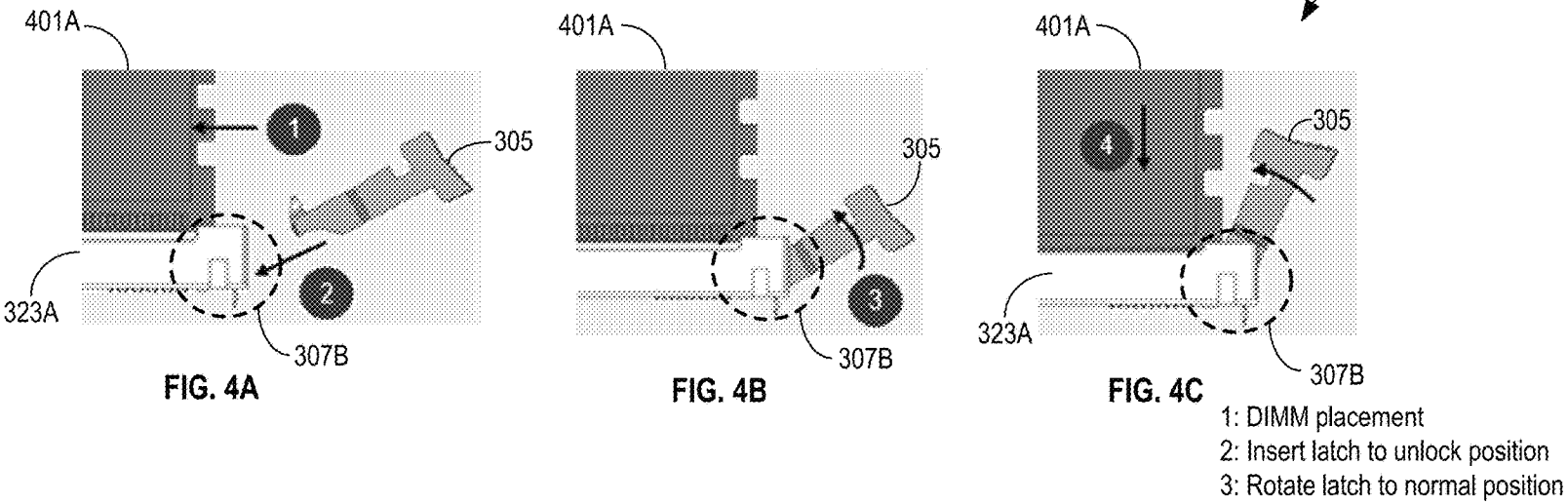
FIG. 4A
FIG. 4B
FIG. 4C
FIG. 4

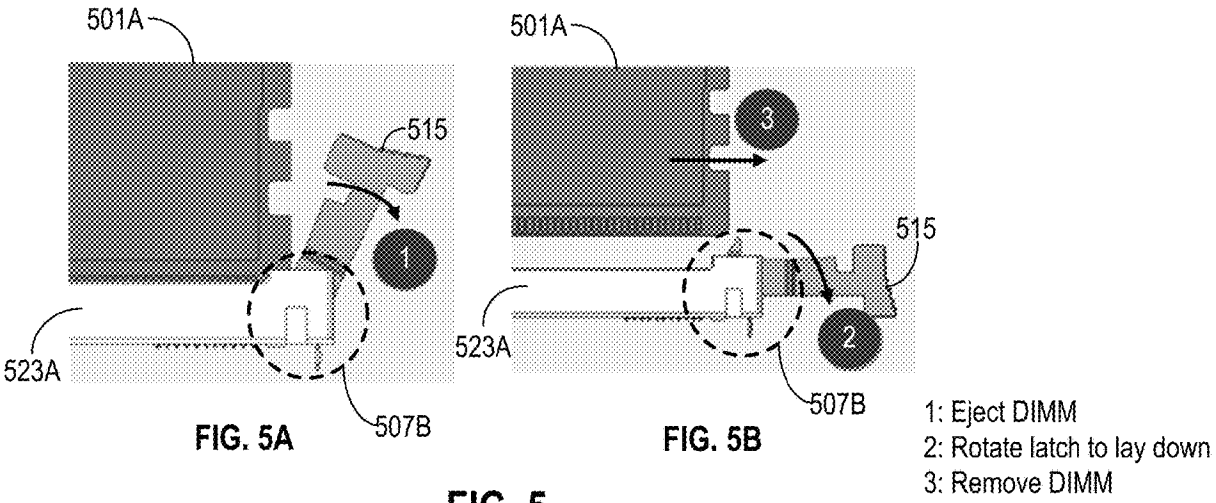
FIG. 5A
FIG. 5B
FIG. 5
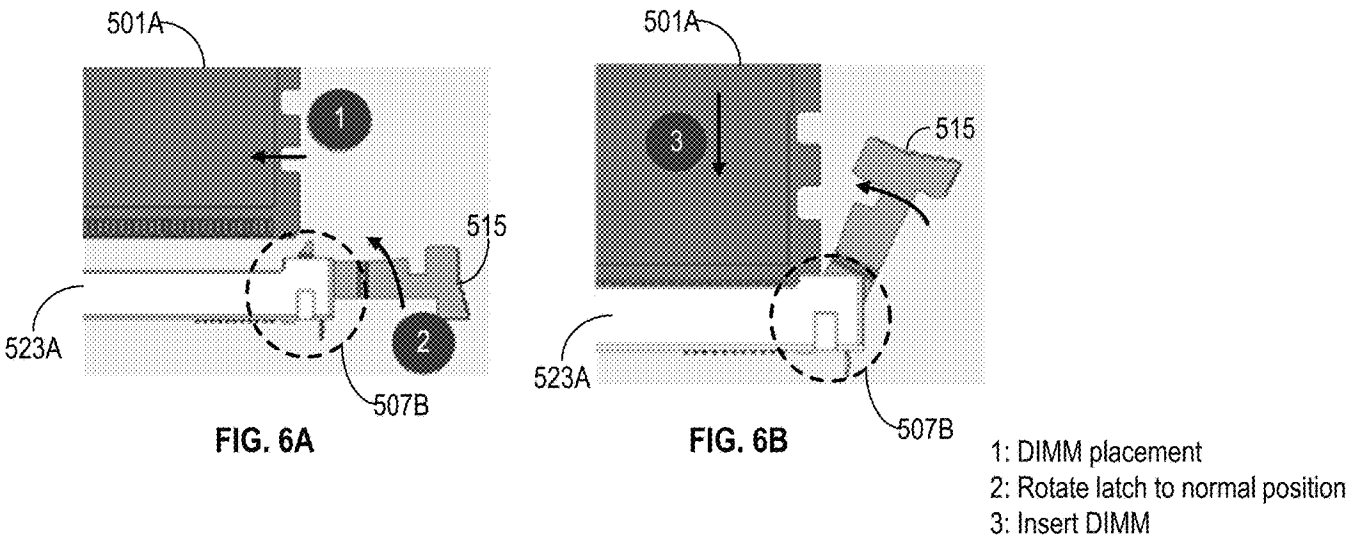
FIG. 6A
FIG. 6B
FIG. 6

DUAL IN-LINE MEMORY MODULES (DIMM) CONNECTOR TOWERS WITH REMOVABLE AND/OR LAY-FLAT LATCHES

FIELD

Embodiments of the present disclosure generally relate to the field of integrated circuits (IC), and more particularly, to connectors for dual-in-line memory modules (DIMMs).

BACKGROUND

In computer devices, a printed circuit board (PCB) or motherboard may be coupled to a plurality of connectors or slots to receive one or more smaller circuit boards or modules, such as a smaller PCB (daughterboard), e.g., dual in-line memory modules (DIMMs). A DIMM is a small circuit board that includes a plurality of electrical components, such as for example, dynamic random access memory (DRAM) integrated circuits. DIMM connectors may be designed for use on a PCB in a chassis of, e.g., platform devices, and/or including, e.g., personal computers, workstations, servers, and consumer products. As central processing unit (CPU) power increases significantly from generation to generation, additional and/or larger components, e.g., CPU heat sinks in the chassis (a metal enclosure or structure used to house a server) are often needed for additional cooling. When the space over the DIMMs is occupied by a heat sink or other component, however, difficulties accessing the DIMMs may occur due to the clearance required to remove or insert the DIMMs. The clearance required is due to the design of the connector, which typically includes raised ends on the opposite sides of the connector (often referred to as connector towers or module support towers), which also integrate a latch or extractor member. When the DIMM (or other daughterboard) is removed, the DIMM is typically ejected and lifted upwards to clear the connector and the latch.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

FIGS. 3A-3C illustrate a side view of an example process associated with removing a DIMM from a connector having a removably coupled latch, in accordance with embodiments of the present disclosure.

FIGS. 4A-4C illustrate a side view of an example process associated with inserting the DIMM into the connector having the removably coupled latch, in accordance with embodiments of the present disclosure.

FIGS. 5A-5B illustrate a side view of an example process associated with removing a DIMM from a connector having a lay-flat latch, in accordance with embodiments of the present disclosure.

FIGS. 6A-6B illustrate a side view of an example process associated with inserting a DIMM into the connector having a lay-flat latch of FIGS. 5A-5B, in accordance with embodiments of the present disclosure.

DETAILED DESCRIPTION

Figure 1:
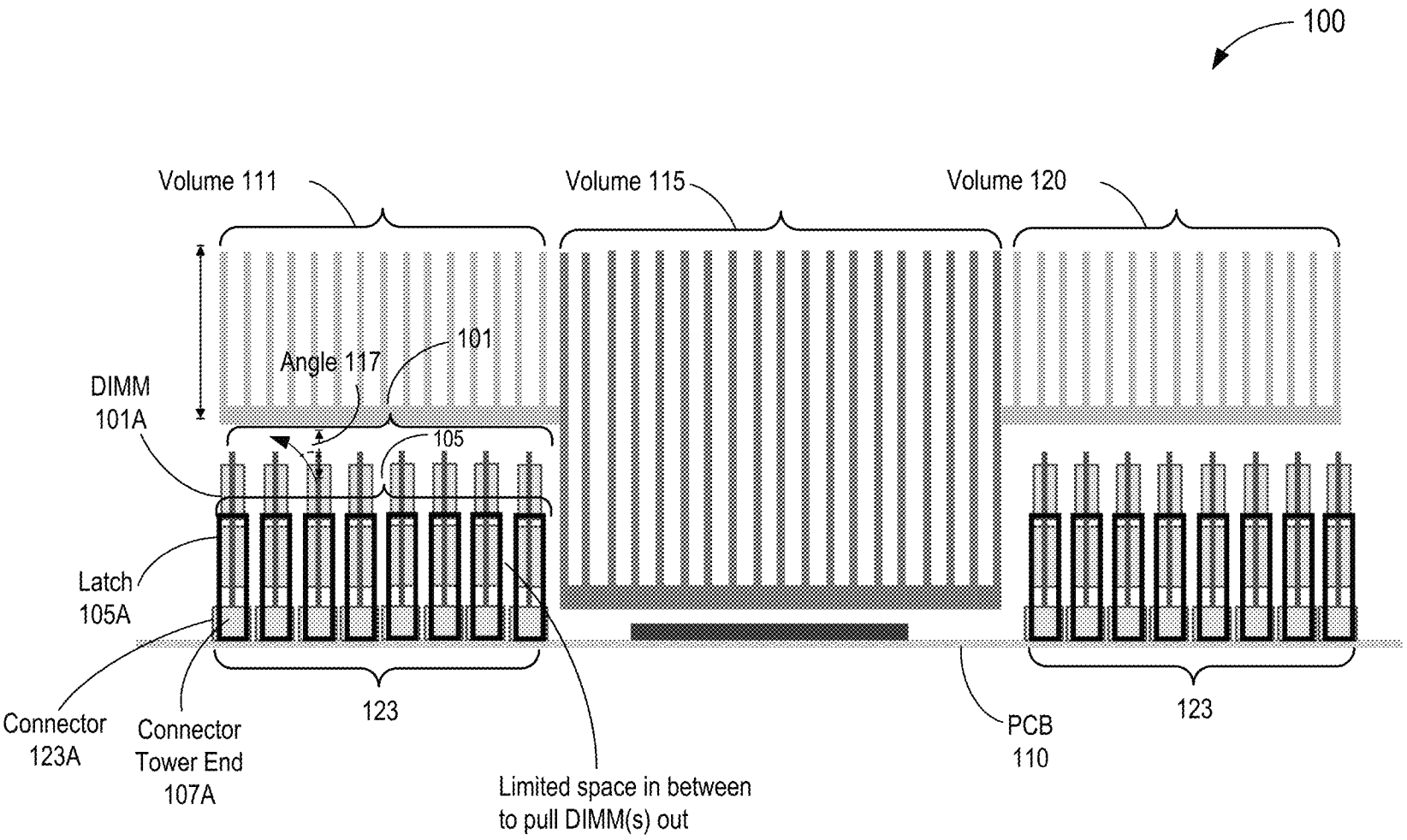
FIG. 1 illustrates an example diagram of a chassis interior, including a plurality of connectors having connector tower end heights to allow a memory module or DIMM to be inserted or removed at an angle, in accordance with embodiments of the present disclosure.

Embodiments described include apparatuses, methods, and systems related to a connector and latches to couple a memory module or board, e.g., a dual in-line memory module (DIMM), to a printed circuit board (PCB). In embodiments, a housing body of the connector includes first and second opposing ends coupled to respective first and second latches to engage the DIMM. In embodiments, the first and the second opposing ends have respective first and second heights having a connector tower height relative to a height of the housing body that allows the DIMM to be inserted or removed at an angle. In some embodiments, one or more of the latches are removably coupled to the connector and/or can be rotated into a lay-flat position to allow the DIMM to be removed at an angle.

In the following description, various aspects of the illustrative implementations will be described using terms commonly employed by those skilled in the art to convey the substance of their work to others skilled in the art. However, it will be apparent to those skilled in the art that embodiments of the present disclosure may be practiced with only some of the described aspects. For purposes of explanation, specific numbers, materials and configurations are set forth in order to provide a thorough understanding of the illustrative implementations. However, it will be apparent to one skilled in the art that embodiments of the present disclosure may be practiced without the specific details. In other instances, well-known features are omitted or simplified in order not to obscure the illustrative implementations.

In the following detailed description, reference is made to the accompanying drawings that form a part hereof, wherein like numerals designate like parts throughout, and in which is shown by way of illustration embodiments in which the subject matter of the present disclosure may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

For the purposes of the present disclosure, the phrase "A and/or B" means (A), (B), (A) or (B), or (A and B). For the purposes of the present disclosure, the phrase "A, B, and/or C" means (A), (B), (C), (A and B), (A and C), (B and C), or (A, B and C).

The description may use perspective-based descriptions such as top/bottom, in/out, over/under, and the like. Such descriptions are merely used to facilitate the discussion and are not intended to restrict the application of embodiments described herein to any particular orientation.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but yet still cooperate or interact with each other, and may mean that one or more other elements are coupled or connected between the elements that are said to be coupled with each other. The term "directly coupled" may mean that two or more elements are in direct contact.

FIG. 1 is an example diagram of a chassis interior 100, illustrating an end view of a plurality of DIMM connectors having connector tower end heights that allow a DIMM to be inserted or removed at an angle, in accordance with embodiments of the present disclosure. As will be shown in connection with the below FIGS, in embodiments, the connector tower ends have heights relative to a height of the housing body of the connector (at a top lengthwise edge of the housing body) to allow a DIMM to be inserted or removed at an angle (e.g., tilted) when disengaged from a first and a second latch. In various embodiments, the connector tower end height is approximately 7-9 mm while the housing body has a height of approximately 4-6 mm.

As shown, FIG. 1 includes a DIMM 101A included in a first plurality of DIMMs 101. In embodiments, each of the first plurality of DIMMs 101 is respectively coupled to each of a first plurality of DIMM connectors 123 (also "connectors 123"). A second plurality of DIMMs and DIMM connectors are shown on the right side of FIG. 1. Note that although one or more of various elements, e.g., DIMM connectors, DIMMs, or plurality of DIMMs, and latches are shown, only one element of each may be labeled for clarity in the FIGs.

In the embodiment, DIMM 101A is coupled via a latch 105A (of a plurality of latches 105) of a connector 123A at a connector tower end 107 to a printed circuit board (PCB) 110. In embodiments that will be discussed further below, latch 105A may be a removably-coupled latch and/or lay-flat latch. Note that example chassis interior 100 includes volume 111 above first plurality of DIMMs 101. In the embodiment, chassis interior 100 also includes a volume 115 that may be a volume that accommodates a standard CPU heatsink. In embodiments, the connector tower end heights (note: a view of connector tower end is shown in more detail in FIG. 2) have a height that allow a memory board, e.g., a DIMM, to be inserted or removed at an angle, e.g., angle 117. Accordingly, extra volume, e.g., volume 111 or 120 can be utilized for additional components, e.g., a heatsink or other cooling device, without impeding removal or insertion of the board. In embodiments, connector tower end 107 has a lowered height (or height lower than a typical tower end height) of a DIMM connector tower end. Note that the connectors as described above can be used in any suitable chassis or enclosure that includes a PCB coupled to a plurality of DIMMS (or other modules). Accordingly, the dimension of the volume that is made available may vary. Referring now to FIG. 2 which illustrates a DIMM connector and latch in further detail.

Figure 2A:
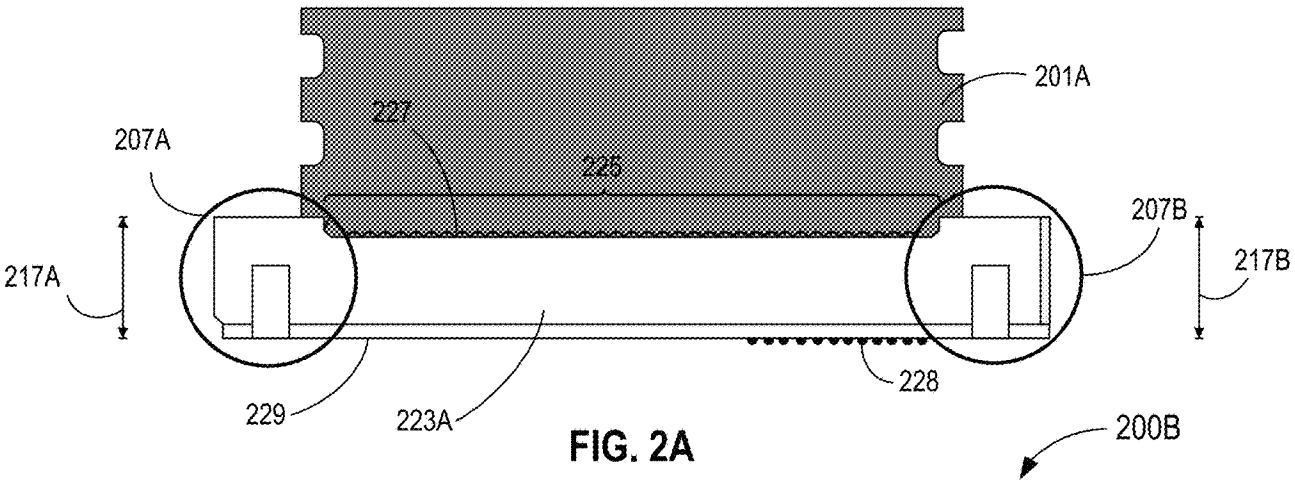
FIGS. 2A and 2B illustrate a side view of a connector, e.g., DIMM connector, in further detail, in accordance with embodiments of the present disclosure.
Figure 2B:
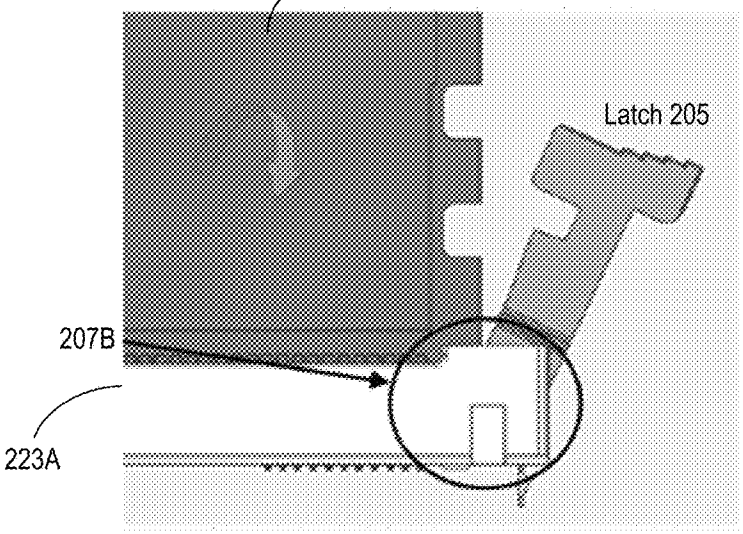

FIG. 2 includes FIG. 2A and FIG. 2B, which illustrate a side view of a DIMM connector and latch, in accordance with embodiments of the present disclosure. FIG. 2A illustrates a DIMM connector 223A, similar to connector 123A of FIG. 1, coupled to a DIMM 201A, e.g., a DIMM that may be the same or similar to DIMM 101A of FIG. 1. In embodiments, DIMM connector 223A has a housing body 225 to couple DIMM 201A to a PCB, e.g., PCB 110 of FIG. 1. In embodiments, as indicated in FIGS. 2A and 2B, housing body 225 includes the area between the opposing raised ends (connector tower ends) of DIMM connector 223A. In embodiments, housing body 225 includes a top lengthwise edge 227 to receive DIMM 201A and a bottom lengthwise edge 229 to couple DIMM 201A to the PCB. In embodiments DIMM 201A includes solder leads or contacts 228 that couple connector 223A to the PCB. In embodiments, a first latch and a second latch may be coupled at respective first and second opposing ends (e.g., connector tower ends 207A and 207B in FIG. 2A) of connector 223A and located on opposing sides of housing body 225 to engage DIMM 201. In embodiments, connector tower ends 207A and 207B have respective first and second heights, e.g., 217A and 217B. In embodiments, each of respective first and second heights 217A and 217B have a height relative to a height of housing body 225 at top lengthwise edge 227 to allow DIMM 201A to be inserted or removed at an angle when disengaged from the first and second latch. Note that in embodiments, the connector tower end heights are higher than the top lengthwise edge of the housing body by approximately 1-3 mm. In embodiments, the housing body has a height at the top lengthwise edge of approximately 4-6 mm. Note that the foregoing heights are merely examples and that any height of the connector tower end relative to the housing body height that is low enough to allow a DIMM to be removed or inserted at an angle is contemplated. In some embodiments, the connector tower ends have a same height as the housing body.

FIG. 2B illustrates an enlarged portion of connector tower end 207B. In FIG. 2B, in embodiments, connector tower end 207B is coupled to a latch 205. In embodiments, latch 205 may be similar or the same as latch 105 of FIG. 1. As will be described in more detail with respect to FIGS. 3 and 4, in embodiments, latch 205 is removably coupled to connector tower end 207B to allow DIMM 201A to be inserted or removed at an angle. In a similar or same embodiments, latch 205 is configured to be a lay-flat latch that may or may not be removed from connector 223A.

Accordingly, FIG. 3, which includes FIGS. 3A-3C, illustrate an example process associated with respectively removing a DIMM from a connector having a removably coupled latch, in an embodiment. FIGS. 4A-4C then illustrate placement (or replacement) of the DIMM into the connector having a removably coupled latch, in accordance with embodiments of the present disclosure. As shown, FIGS. 3A-3C and 4A-4C have similar elements, e.g., a portion of a DIMM 301A (e.g., similar or the same as portion of DIMM 201A in FIG. 2), connector 323A (e.g., similar or the same as connector 223A of FIG. 2), latch 305 (similar or the same as latch 205 of FIG. 2) and connector tower end 307B (similar or the same as connector tower end 207B of FIG. 2). Note that in embodiments, latch 305 includes a protrusion 306.

To begin, as shown in FIG. 3A, DIMM 301A may be ejected, by exerting downward pressure on latch 305 or otherwise moving latch downward towards a horizontal position at element 1. Next, in FIG. 3B, latch 305 is then rotated laterally, to an unlock position, as indicated in element 2. In FIG. 3C, latch 305 is removably coupled to connector tower end 307B, thus, can be removed at element 3, releasing DIMM 301A from connector 323A. Note that any suitable locking or unlocking mechanisms can be used to allow latch 305 to be removed from connector tower end 307B. In some embodiments, connector tower end 307B is configured with a notch or opening to allow protrusion 306, which may also assist in ejecting DIMM 301A, to slide out of connector tower end 307B. Accordingly, removing latch 305 from connector 323A, means that latch 305 will not impede removal of DIMM 301A from connector 323A in any direction relative to connector 323A, e.g., above connector 323 or laterally (e.g., as shown by the arrow under element 4). In embodiments, DIMM 301A is removed by tilting DIMM 301A (e.g., lifting DIMM 301A out of connector 323A at an angle from the horizontal or, normal to the PCB).

Referring now to FIGS. 4A-4C, which as noted above, illustrates an example process associated with placement (or replacement) of the DIMM into the connector having the removably coupled latch. To begin, in FIG. 4A, DIMM 301A is first placed into connector 323A, at element 1. In the embodiment, as indicated by element 2, latch 305 is inserted in an unlock position into connector tower end 307B. Next, in the embodiment of FIG. 4B, latch 305 is rotated to its lock (also referred to as normal) position, as indicated by element 3. Next, in FIG. 4C, latch 305 is moved upwards to engage DIMM 301, which exerts a downward pressure on DIMM 301A and locks DIMM 301A into connector 323A.

Referring now to FIGS. 5 and 6, which illustrate example processes associated with respectively removing and inserting (or replacing) a DIMM from a DIMM connector having a lay-flat latch, in embodiments. Note that, as shown, FIGS. 5A-5B and FIGS. 6A-6B have similar elements, e.g., a portion of a DIMM 501A, a DIMM connector 523A, a latch 515, and a connector tower end 507B. To begin, in the embodiment of FIG. 5A, DIMM 501A is ejected at element 1 (e.g., decoupled from mating connections of a PCB (e.g., PCB 110 of FIG. 1)), by exerting downward pressure on latch 515 or otherwise moving latch 515 downwards towards a horizontal or lay-flat position. Next, in the embodiment, at element 2 of FIG. 5B, latch 515 is rotated to a lay down or into a lay-flat position. In the embodiment, in the lay-flat position, DIMM 501A is released. In embodiments, the lay-flat position is a substantially horizontal position. In embodiments, at element 3, DIMM 501A can then be removed. In embodiments, due to a height of connector tower end 507B, DIMM 501A can be removed by tilting DIMM 501A. Furthermore, in embodiments, DIMM 501A can be removed by moving DIMM 501A laterally over latch 515, due to additional free area or volume over latch 515 due to its lay-flat position. In embodiments, latch 515 may or may not be removably coupled to DIMM connector 523A. Furthermore, connector 523A and/or connector tower end 523A may be similar or the same as connector 323A and connector tower end 307B of FIGS. 3 and 4 that may accommodate latch 305 of FIGS. 3 and 4.

Referring now to FIGS. 6A-6B which as noted above, illustrates an example process associated with placement (and/or replacement) of the DIMM into the DIMM connector coupled to a lay-flat latch, in accordance with embodiments of the present disclosure. To begin, in the embodiment of FIG. 6A, DIMM 501A is placed over DIMM connector 523A (see arrow accompanying element 1). In embodiments, DIMM 501A can be moved laterally over latch 515 due to additional volume over latch 515 due to its lay-flat position. At element 2, in the embodiments, latch 515 is rotated from its lay-flat position to its normal position (e.g., aligned perpendicular to the, e.g., PCB 110 of FIG. 1 or with a normal vector to the plane of the PCB). Note that in embodiments, element 2 may occur during, prior to, or after element 1 (rotation of latch 515), but is shown in the present order for ease of explanation. In FIG. 6B, in the embodiment, DIMM 501A is inserted by engaging latch 515 when, as indicated by the arrow at element 3, a downward pressure is exerted on DIMM 501A.

Figure 7:
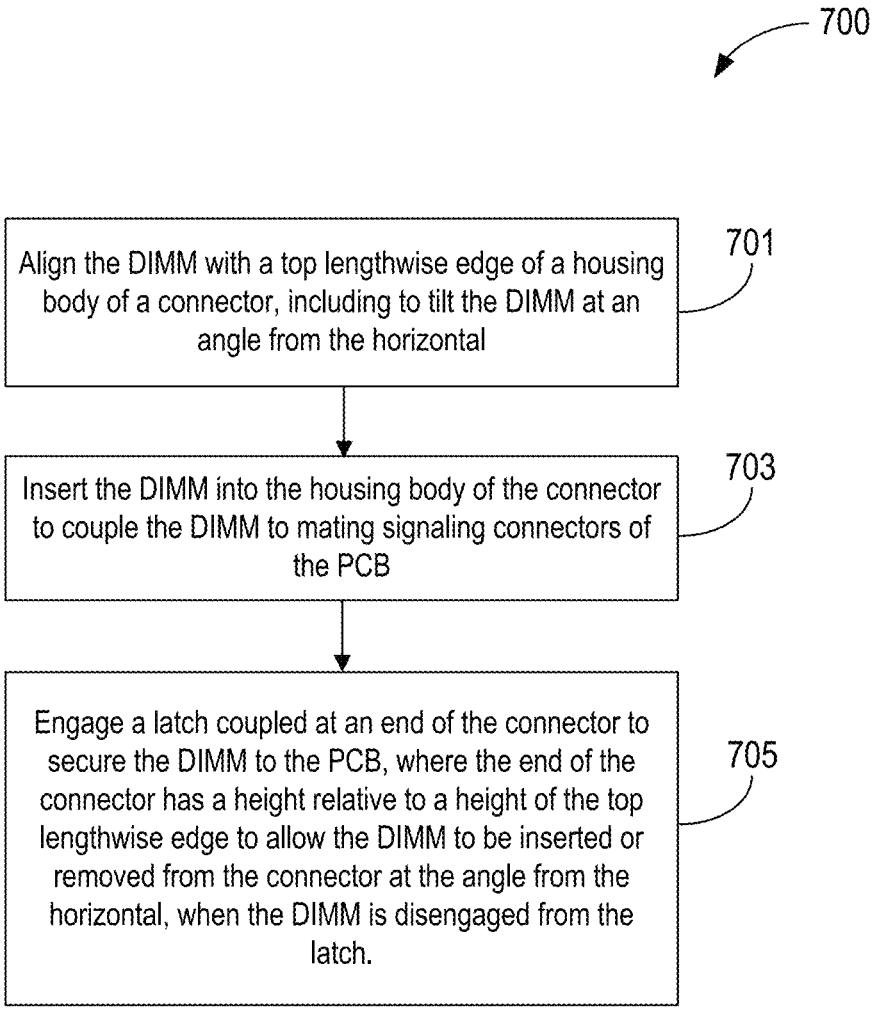
FIG. 7 is a flow diagram of an example process associated with inserting a DIMM into the connector coupled to a removable and/or lay-flat latch, in accordance with embodiments of the present disclosure.

Referring now to FIG. 7, which is a flow diagram describing process 700, associated with the connector and the removably coupled and/or lay-flat latches associated with FIGS. 2-6 above. In embodiments, process 700 describes a method of coupling a DIMM to a PCB, e.g., PCB 110 of FIG. 1. Note that in some embodiments, decoupling the DIMM may include a reversal of order of the blocks. Beginning at block 701, process 700 includes aligning the DIMM with a top lengthwise edge (e.g., see 227 of FIG. 2A) of a housing body of a connector (e.g., connector 323A of FIG. 3 or 523A of FIG. 5), including to tilt the DIMM at an angle from the vertical plane (e.g., angle 117 of FIG. 1, which may be an angle from the normal vector to the horizontal plant of the PCB). Next, in the embodiment, at block 703, process 700 includes inserting the DIMM into the housing body of the connector to couple the DIMM to mating signaling connectors (not shown) of the PCB. At block 705, process 700 includes engaging a latch coupled at an end of the connector to secure the DIMM to the PCB. In embodiments, the tower end of the connector has a height relative to a height of the top lengthwise edge to allow the DIMM to be inserted or removed from the connector at the angle from the horizontal, when the DIMM is disengaged from the latch. Note that, in embodiments, first and the second latches are to engage the DIMM, e.g., DIMM 501A, when the latches are in a perpendicular position relative to the PCB and to disengage the DIMM when the latches are in a lay-flat position relative to the PCB. In embodiments, the perpendicular position is a substantially vertical position and the lay-flat position is a substantially horizontal position. Furthermore, the first and the second latches are rotatable to an unlock position prior to disengagement of the DIMM. Note that although the examples given pertain to DIMMs, embodiments may apply to any suitable connector for other types of devices, modules, or boards to be coupled to a PCB, that may benefit from a connector tower end height and/or removably coupled and/or lay-flat latches that allows the device to be inserted and/or removed at an angle.

Figure 8:
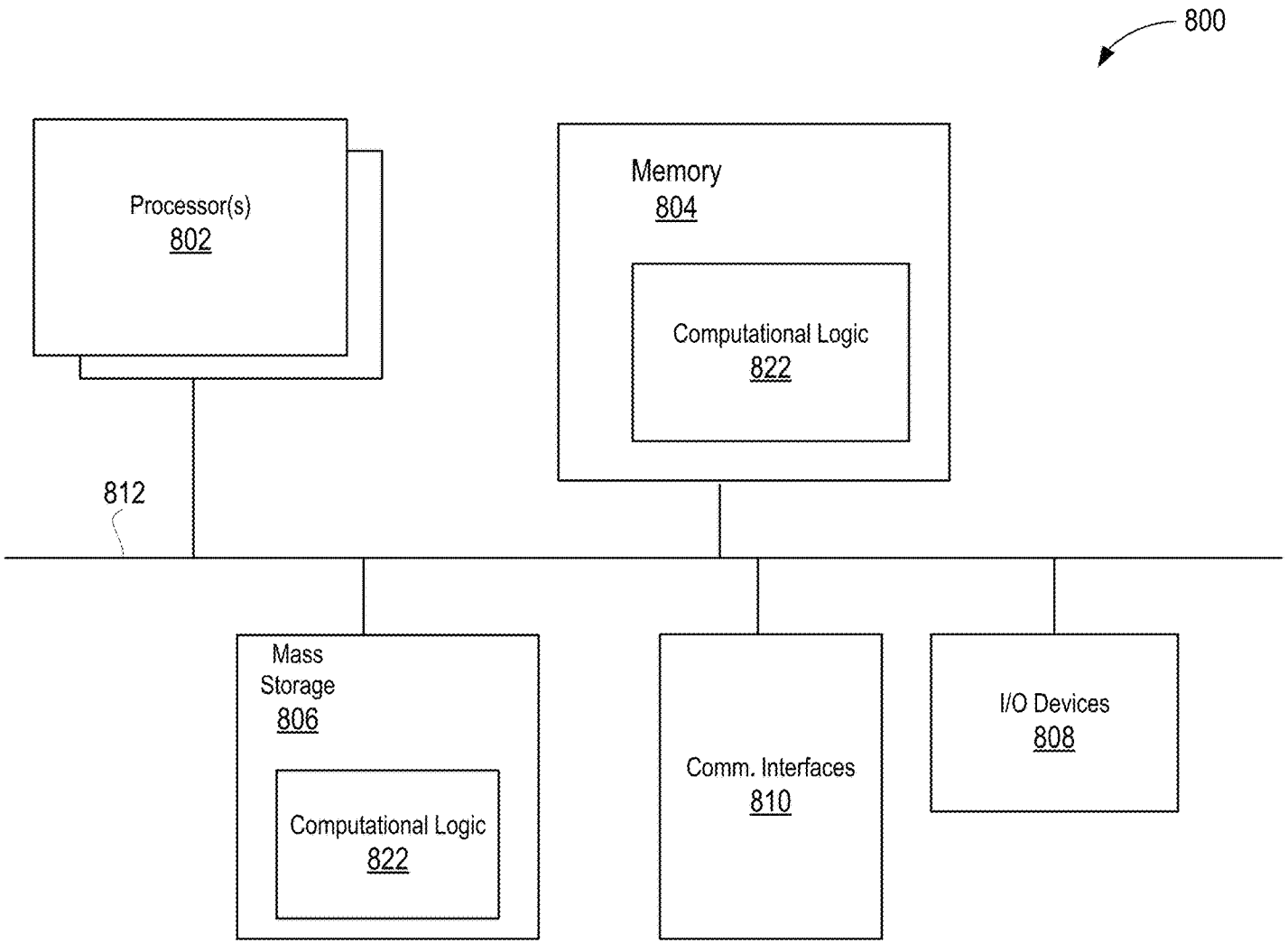
FIG. 8 is a schematic of a computing system, in accordance with embodiments of the present disclosure.

FIG. 8 illustrates an example electronic device 800 (e.g., a computer, a server, or some other electronic device) that may be suitable to practice selected aspects of the present disclosure. In embodiments, the system or electronic device 800 includes, a dual in-line memory module (DIMM) coupled to a PCB via a connector. As shown, electronic device 800 may include one or more processors or processor cores 802. For the purpose of this application, including the claims, the term "processors" refers to physical processors, and the terms "processor" and "processor cores" may be considered synonymous, unless the context clearly requires otherwise. The electronic device 800 may include one or more memories 804, which may include one more DIMMs coupled to a connector with removably coupled latches (and/or lay-flat latches) on a PCB as described herein, e.g., FIGS. 1-7. In embodiments, the connector includes a housing body to couple the DIMM to the PCB, wherein the housing body includes a top lengthwise edge to receive the DIMM and a bottom lengthwise edge to couple the DIMM to the PCB. The housing body also includes first and second opposing ends of the connector; and a first and a second latch coupled at the respective first and second opposing ends of the connector to engage the DIMM. In embodiments, the first and the second opposing ends have respective first and second heights and wherein the first and/or the second height relative to the height of the housing body at the top lengthwise edge is to allow the DIMM to be inserted or removed at an angle when disengaged from the first and second latch.

In some embodiments, electronic device 800 is enclosed in a chassis. In embodiments, electronic device 800 further includes a heatsink and the chassis includes a volume above a plurality of DIMMs including the DIMM.

In embodiments, a memory device mounted on the DIMM includes an NVM device, e.g., a byte-addressable write-in-place three dimensional crosspoint memory device, or other byte addressable write-in-place NVM devices (also referred to as persistent memory), such as single or multi-level Phase Change Memory (PCM) or phase change memory with a switch (PCMS), NVM devices that use chalcogenide phase change material (for example, chalcogenide glass), resistive memory including metal oxide base, oxygen vacancy base and Conductive Bridge Random Access Memory (CB-RAM), nanowire memory, ferroelectric random access memory (FeRAM, FRAM), magneto resistive random access memory (MRAM) that incorporates memristor technology, spin transfer torque (STT)-MRAM, a spintronic magnetic junction memory based device, a magnetic tunneling junction (MTJ) based device, a DW (Domain Wall) and SOT (Spin Orbit Transfer) based device, a thyristor based memory device, or a combination of any of the above, or other memory.

In embodiments, DIMM is a double data rate (DDR) synchronous random-access memory (DDR SRAM) DIMM and/or the RAM components include a memory unit or medium including a cross-point memory array.

Note that a memory subsystem as described herein may be compatible with a number of memory technologies, such as DDR3 (Double Data Rate version 3, original release by JEDEC (Joint Electronic Device Engineering Council) on Jun. 27, 2007), DDR4 (DDR version 4, initial specification published in September 2012 by JEDEC), DDR4E (DDR version 4), LPDDR3 (Low Power DDR version3, JESD209-3B, August 2013 by JEDEC), LPDDR4) LPDDR version 4, JESD209-4, originally published by JEDEC in August 2014), WIO2 (Wide Input/Output version 2, JESD229-2 originally published by JEDEC in August 2014, HBM (High Bandwidth Memory, JESD325, originally published by JEDEC in October 2013, DDR5 (DDR version 5, currently in discussion by JEDEC), LPDDR5 (currently in discussion by JEDEC), HBM2 (HBM version 2), currently in discussion by JEDEC, or others or combinations of memory technologies, and technologies based on derivatives or extensions of such specifications.

Additionally, electronic device 800 may include mass storage devices 806 (such as diskette, hard drive, compact disc read-only memory (CD-ROM) and so forth), input/output (I/O) devices 808 (such as display, keyboard, cursor control and so forth) and communication interfaces 810 (such as network interface cards, modems and so forth). The elements may be coupled to each other via system bus 812, which may represent one or more buses. In the case of multiple buses, they may be bridged by one or more bus bridges (not shown). Each of these elements may perform its conventional functions known in the art. In particular, in some embodiments, memory 804 and mass storage devices 806 may be employed to store a working copy and a permanent copy of the programming instructions configured to perform one or more processes or memory/storage transactions for the electronic device 800. The programming instructions may be collectively referred to as controller logic 822. The various elements may be implemented by assembler instructions supported by processor(s) 802 or high-level languages, such as, for example, C, that can be compiled into such instructions.

The number, capability and/or capacity of the elements shown in FIG. 8 may vary, depending on whether electronic device 800 is used as a server, communication device, or some other type of computing device. When used as a server device, the capability and/or capacity of the elements shown in FIG. 8 may also vary, depending on whether the server is a single stand-alone server or a configured rack of servers or a configured rack of server elements.

Otherwise, the constitutions of the elements shown in FIG. 8 may be known, and accordingly will not be further described.

The terminology used herein is for the purpose of describing particular embodiments only and is not intended to be limiting of the disclosure. As used herein, the singular forms "a," "an" and "the" are intended to include plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Thus various example embodiments of the present disclosure have been described including, but not limited to:

Example 1 may include an apparatus, comprising: a connector to couple a dual in-line memory module (DIMM) to a printed circuit board (PCB), wherein the connector includes first and second opposing ends; and a housing body between the first and second opposing ends, wherein the housing body includes a top lengthwise edge to receive the DIMM and a bottom lengthwise edge to couple the DIMM to the PCB; and a first latch and a second latch coupled at the respective first and second opposing ends of the connector to engage the DIMM, wherein the first and the second opposing ends have respective first and second heights relative to a height of the housing body to allow the DIMM to be inserted or removed at an angle when disengaged from the first and second latch.

Example 2 may be the apparatus of Example 1, wherein the first and second heights include respective first and second connector tower end heights.

Example 3 may be the apparatus of Example 2, wherein the connector tower end heights are higher than the top lengthwise edge of the housing body by approximately 1-3 millimeters (mm).

Example 4 may be the apparatus of Example 1, wherein the first latch and the second latch are to engage the DIMM when the first latch and the second latch are in a perpendicular position relative to the PCB and to disengage the DIMM when the first latch and the second latch are in a lay-flat position relative to the PCB.

Example 5 may be apparatus of Example 4, wherein the perpendicular position is a substantially vertical position and the lay-flat position is a substantially horizontal position.

Example 6 may be the apparatus of Example 1, wherein the first latch and the second latch are removably coupled to the connector.

Example 7 may be the apparatus of Example 5, wherein the first latch and the second latch are removable from the connector after disengagement of the DIMM.

Example 8 may be the apparatus of Example 5, wherein the first latch and the second latch are rotatable to an unlock position prior to disengagement of the DIMM.

Example 9 may be the apparatus of any one of Examples 1-8, wherein the DIMM comprises a double data rate (DDR) synchronous random-access memory (DDR SRAM) DIMM.

Example 10 may be a method of coupling a dual in-line memory module (DIMM) to a printed circuit board (PCB), comprising aligning the DIMM with a top lengthwise edge of a housing body of a connector, wherein aligning the DIMM includes tilting the DIMM at an angle from horizontal; inserting the DIMM into the housing body of the connector to couple the DIMM to mating signaling connectors of the PCB; and engaging a latch coupled at an end of the connector to secure the DIMM to the PCB, wherein the end of the connector has a height relative to a height of the top lengthwise edge to allow the DIMM to be inserted or removed from the connector at the angle from the horizontal, when the DIMM is disengaged from the latch.

Example 11 may be the method of Example 10, wherein prior inserting the DIMM into the housing body, the method includes rotating the latch to an unlock position.

Example 12 may be the method of Example 10, wherein the end of the connector has a connector tower end height that is higher than the top lengthwise edge of the housing body by approximately 1-3 millimeters (mm).

Example 13 may be a system, comprising: a dual in-line memory module (DIMM); a printed circuit board (PCB); and a connector including: a housing body to couple the DIMM to the PCB, wherein the housing body includes a top lengthwise edge to receive the DIMM and a bottom lengthwise edge to couple the DIMM to the PCB; first and second opposing ends of the connector; and a first latch and a second latch coupled at the respective first and second opposing ends of the connector to engage the DIMM, wherein the first and the second opposing ends have respective first and second heights relative to the height of the housing body at the top lengthwise edge to allow the DIMM to be inserted or removed at an angle when disengaged from the first and second latch.

Example 14 may be the system of Example 13, wherein the first and second heights include first and second connector tower end heights that are higher than the top lengthwise edge of the housing body by approximately 1-3 mm.

Example 15 may be the system of Example 13, wherein the first and the second latches are to engage the DIMM when the latches are in a perpendicular position relative to the PCB and to disengage the DIMM when the latches are in a lay-flat position relative to the PCB.

Example 16 may be the system of Example 13, wherein the first and the second latches are removably coupled to the connector.

Example 17 may be the system of Example 16, wherein the first and the second latches are removable from the connector after disengagement of the DIMM.

Example 18 may be the system of Example 13, wherein the first latch and the second latches are rotatable to an unlock position prior to disengagement of the DIMM.

Example 19 may be the system of Example 13, further comprising a heatsink and a chassis including a volume above a plurality of DIMMs including the DIMM to fit the heatsink.

Example 20 may be the system of any of Examples 13-19, wherein the DIMM includes one or more byte-addressable persistent memory devices.

Various embodiments may include any suitable combination of the above-described embodiments including alternative (or) embodiments of embodiments that are described in conjunctive form (and) above (e.g., the "and" may be "and/or"). Furthermore, some embodiments may include one or more articles of manufacture (e.g., non-transitory computer-readable media) having instructions, stored thereon, that when executed result in actions of any of the above-described embodiments. Moreover, some embodiments may include apparatuses or systems having any suitable means for carrying out the various operations of the above-described embodiments.

The above description of illustrated implementations, including what is described in the Abstract, is not intended to be exhaustive or to limit the embodiments of the present disclosure to the precise forms disclosed. While specific implementations and examples are described herein for illustrative purposes, various equivalent modifications are possible within the scope of the present disclosure, as those skilled in the relevant art will recognize.

These modifications may be made to embodiments of the present disclosure in light of the above detailed description. The terms used in the following claims should not be construed to limit various embodiments of the present disclosure to specific implementations disclosed in the specification and the claims. Rather, the scope is to be determined entirely by the following claims, which are to be construed in accordance with established doctrines of claim interpretation.

What is claimed is:

1. An apparatus, comprising:

a connector to couple a dual in-line memory module (DIMM) to a printed circuit board (PCB), wherein the connector includes:

first and second opposing ends; and a housing body between the first and second opposing ends, wherein the housing body includes a top lengthwise edge to receive the DIMM and a bottom lengthwise edge to couple the DIMM to the PCB; and a first latch and a second latch coupled at the respective first and second opposing ends of the connector to engage the DIMM, wherein the first and second latches are engageable to respective first and second sides of the DIMM, at respective first and second portions of the first and second sides, wherein the first and second sides of the DIMM extend out of the first and second portions in response to the engagement of the first and second portions with the first and second latches, wherein the first and the second opposing ends have respective first and second heights relative to a height of the housing body to allow the DIMM to be inserted or removed at an angle when disengaged from the first latch and the second latch, wherein the first latch and the second latch are coupled to the connector to be removable, at an acute angle relative to the first and second opposing ends, prior to removal of the DIMM by sliding each of the first latch and the second latch away from the respective first and second opposing ends of the connector.

2. The apparatus of claim 1, wherein the first latch and the second latch are removable from the connector after disengagement of the DIMM.

3. The apparatus of claim 1, wherein the first latch and the second latch are rotatable to an unlock position prior to disengagement of the DIMM.

4. The apparatus of claim 1, wherein the DIMM comprises a double data rate (DDR) synchronous random-access memory (DDR SRAM) DIMM.

5. A system, comprising:

a dual in-line memory module (DIMM);

a printed circuit board (PCB); and a connector including:

a housing body to couple the DIMM to the PCB, wherein the housing body includes a top lengthwise edge to receive the DIMM and a bottom lengthwise edge to couple the DIMM to the PCB;

first and second opposing ends of the connector; and a first latch and a second latch coupled at the respective first and second opposing ends of the connector to engage the DIMM, wherein the first and second latches are engageable to respective first and second sides of the DIMM, at respective first and second portions of the first and second sides, wherein the first and second sides of the DIMM extend out of the first and second portions in response to the engagement of the first and second portions with the first and second latches, wherein the first and the second opposing ends have respective first and second heights relative to a height of the housing body at the top lengthwise edge to allow the DIMM to be inserted or removed at an angle when disengaged from the first and second latches, wherein the first latch and the second latch are coupled to the connector to be removable, at an acute angle relative to the first and second opposing ends, prior to removal of the DIMM by sliding each of the first latch and the second latch away from the respective first and second opposing ends of the connector.

6. The apparatus of claim 1, wherein the first and second heights include respective first and second connector tower end heights.

7. The apparatus of claim 6, wherein the first and the second connector tower end heights are higher than the top lengthwise edge of the housing body by approximately 1-3 millimeters (mm).

8. The apparatus of claim 1, wherein the first latch and the second latch are to engage the DIMM when the first latch and the second latch are in a perpendicular position relative to the PCB and to disengage the DIMM when the first latch and the second latch are in a lay-flat position relative to the PCB.

9. The apparatus of claim 8, wherein the perpendicular position is a substantially vertical position and the lay-flat position is a substantially horizontal position.

10. A method of coupling a dual in-line memory module (DIMM) to a printed circuit board (PCB), comprising:

aligning the DIMM with a top lengthwise edge of a housing body of a connector, wherein aligning the DIMM includes tilting the DIMM at an acute angle from horizontal;

inserting the DIMM into the housing body of the connector to couple the DIMM to mating signaling connectors of the PCB; and engaging a latch coupled at an end of the connector to secure the DIMM to the PCB, wherein the end of the connector has a height relative to a height of the top lengthwise edge to allow the DIMM to be inserted into or removed from the connector at the acute angle from the horizontal, wherein engaging the latch includes attaching the latch to a side of the DIMM, at a portion of the side, wherein the side of the DIMM is to extend out of the portion in response to the attaching the latch with the portion, when the DIMM is disengaged from the latch and wherein the latch is coupled to be removable from the connector prior to removal of the DIMM by sliding the latch away from the end of the connector.

11. The method of claim 10, wherein prior to inserting the DIMM into the housing body, the method further includes rotating the latch to an unlock position.

12. The method of claim 10, wherein the end of the connector has a connector tower end height that is higher than the top lengthwise edge of the housing body by approximately 1-3 millimeters (mm).

13. The system of claim 5, wherein the first and the second latches are removable from the connector after disengagement of the DIMM.

14. The system of claim 5, wherein the first and second heights include first and second connector tower end heights that are higher than the top lengthwise edge of the housing body by approximately 1-3 mm.

15. The system of claim 5, wherein the first and the second latches are to engage the DIMM when the latches are in a perpendicular position relative to the PCB and to disengage the DIMM when the latches are in a lay-flat position relative to the PCB.

16. The system of claim 5, wherein the first latch and the second latch are rotatable to an unlock position prior to disengagement of the DIMM.

17. The system of claim 5, further comprising a heatsink and a chassis including a volume above a plurality of DIMMs including the DIMM to fit the heatsink.

18. The system of claim 5, wherein the DIMM includes one or more byte-addressable persistent memory devices.

* * * * *